US007178199B2

(12) United States Patent
Kashiwaguma

(10) Patent No.: US 7,178,199 B2
(45) Date of Patent: Feb. 20, 2007

(54) HINGE

(75) Inventor: Kazuaki Kashiwaguma, Tokyo (JP)

(73) Assignee: Sugatsune Kogyo Co., Ltd. (JP)

( * ) Notice: Subject to any disclaimer, the term of this patent is extended or adjusted under 35 U.S.C. 154(b) by 147 days.

(21) Appl. No.: 10/511,952

(22) PCT Filed: Apr. 23, 2003

(86) PCT No.: PCT/JP03/05156

§ 371 (c)(1),
(2), (4) Date: Oct. 21, 2004

(87) PCT Pub. No.: WO03/091521

PCT Pub. Date: Nov. 6, 2003

(65) Prior Publication Data

US 2005/0172451 A1 Aug. 11, 2005

(30) Foreign Application Priority Data

Apr. 26, 2002 (JP) ..... 2002-127669

(51) Int. Cl.
*E05D 7/10* (2006.01)

(52) U.S. Cl. ..... 16/258; 16/382

(58) Field of Classification Search ..... 16/258, 16/257, 254, 382, 383, 271, 272
See application file for complete search history.

(56) References Cited

U.S. PATENT DOCUMENTS 4,691,408 A * 9/1987 Rock et al. ..... 16/241
4,715,409 A * 12/1987 Graf ..... 139/88
4,823,436 A * 4/1989 Salice ..... 16/258
4,850,080 A * 7/1989 Rock et al. ..... 16/236
5,056,189 A * 10/1991 Brustle et al. ..... 16/235
5,105,506 A * 4/1992 Lin ..... 16/258
6,032,333 A * 3/2000 Brustle ..... 16/242
6,105,809 A * 8/2000 Yamanaka ..... 220/326
6,675,440 B1 * 1/2004 Lautenschlager ..... 16/258

FOREIGN PATENT DOCUMENTS

DE 2357612 A * 5/1975
DE 3939080 A1 * 5/1990

(Continued)

*Primary Examiner*—Chuck Y. Mah
(74) *Attorney, Agent, or Firm*—Osha Liang L.L.P.

(57) ABSTRACT

The distal end part of an arm 5 is turnably and removably connected to the distal end part of a base part 5 through a connection mechanism 7. An engagement recess 46 whose upper part opposing the arm 5 is open, is formed in a basal end part of the base part 2. The arm 5 is provided at its basal end part with an engagement pin 8 capable of fitting in the engagement recess 46 when the arm 5 is turned to an attachment position. A lock lever 6 for pressing the engagement pin 8 against the bottom part of the engagement recess 46 under the biasing force of a coiled spring 9, is turnably disposed at the distal end part of the base part 2 through a support pin 103. The lock lever 6 is provided at its distal end part with a pressing part 67 for pushing up the engagement pin 8 so as to escape from the engagement recess 46 when the lock lever 6 is turned clockwise against the biasing force of the coiled spring 9.

10 Claims, 15 Drawing Sheets

FOREIGN PATENT DOCUMENTS

| | | | |
|---|---|---|---|
| GB | 2183722 A | * | 6/1987 |
| JP | 01247679 A | * | 10/1989 |
| JP | 6-29414 | | 8/1990 |
| JP | 03172474 A | * | 7/1991 |
| JP | 8-4548 | | 9/1991 |

* cited by examiner

HINGE

TECHNICAL FIELD

This invention relates to a hinge in which an arm is connected to a base part through a lock lever.

BACKGROUND ART

As a conventional hinge of this type, there is one disclosed in, for example, Japanese Utility Model Publication No. H06-29414. This hinge includes a base part and an arm. One end of an arm is turnably and longitudinally removably connected to longitudinal one end part of the base part through a connection mechanism. On the other hand, an engagement recess, which is open toward the arm side, is formed in the other end part of the base part. An engagement part, which is engageable in the engagement recess when the arm is turned to a predetermined attachment position in an approaching direction to the base part, is formed at the other end part of the base part.

A lock lever, which is turn biased in one direction by a coiled spring, is turnably disposed at the other end part of the base part. This lock lever is provided at one end part thereof with a lock part. When the lock lever is turned to a predetermined lock position in one direction, the lock part is engaged with the other end part of the arm which is located in the attachment position, so that the arm is prevented from turning in the other direction from the attachment position of the arm. When the lock lever is turned in the other direction from the lock position, the lock part is separated from the other end part of the arm to allow the arm to turn in the other direction.

In the hinge thus construction, in case the arm is to be removed from the base part, first, the lock arm is turned in the other direction from the lock position. Then, the arm is separatingly turned such that the other end part of the arm is separated from the other end part of the base part, so that the engagement part is escaped from the engagement recess. Thereafter, the arm is moved in the longitudinal direction of the base part to cancel the connecting relation between the base part and the arm which connecting relation is realized by the connection mechanism. By this, the arm can be removed from the base part.

In the above conventional hinge, when the arm is to be removed from the base part, it is necessary that the other end part of the arm is moved in the separating direction from the base part and the arm is moved in the longitudinal direction of the base part. This means that two steps of moving operation are required. Therefore, there is such a problem that much time and labor are required for removing the arm.

DISCLOSURE OF THE INVENTION

This invention has been made in order to solve the above-mentioned problem. According to the present invention, there is provided a hinge comprising a base part, an arm, a connection mechanism disposed between one end part of the base part and one end part of the arm and adapted to turnably and removably, in the axial direction of the base part, connect one end part of the arm to one end part of the base part so that the other end part of the arm can approach or separate from the other end part of the base part, a lock lever turnably disposed at the other end part of the base part, and a turn biasing means for turn-biasing the lock lever in one direction, one of the other end parts of the base part and the arm which are opposing to each other in the turning direction of the arm being formed with an engagement recess which is open toward the other, the other being provided with an engagement part which is brought into the engagement recess through its opening part when the arm is turned to a predetermined attachment position in a direction approaching the other end part of the base part, the lock lever being provided at one end part thereof with a lock part, the lock part being brought into engagement with the other end part of the arm located in the attachment position so that the arm is prevented from turning in a direction away from the attachment position when the lock lever is turned to a predetermined lock position in the one direction by a biasing force of the turn biasing means, the lock part being separated from the other end part of the arm to allow the other end part of the arm to turn in the separating direction so that the engagement part can escape from the engagement recess when the lock lever is turned in the other direction from the lock position, wherein the lock lever being provided at one end part thereof with a pressing part, the pressing part being butted with the other end part of the arm located in the attachment position, to turn the other end part of the arm in a separating direction from the other end part of the base part so that the engagement part can escape from the engagement recess when the lock lever is turned in the other direction from the lock position against the biasing force of the turn biasing means.

It is preferred that the connection mechanism includes a support recess formed in one end part of one of the base part and the arm and a connection pin part disposed at one end part of the other of the base part and the arm, the support recess being disposed with a longitudinal direction of the support recess placed in a longitudinal direction of the above-mentioned one of the base part and the arm, the connection pin part being inserted in the support recess, through an opening part of the support recess, until the connection pin part reaches a bottom part of the support recess and turnably supported by the bottom part of the support recess, thereby turnably connecting one end part of the arm to one end part of the base plate.

It is also preferred that the engagement recess and the engagement part are set to be equal to each other in width in the longitudinal direction of the base part, so that when the engagement part is brought into the engagement recess, the arm is non-movably connected to the base part in the longitudinal direction of the base part.

Preferably, the opening side end part of the engagement recess is connected with an introduction part for allowing the engagement part to be brought into the engagement recess when the arm is approachingly turned to the attachment position, and the width of the introduction part in the longitudinal direction of the base part is set to be larger than the width of the engagement part in the same direction, so that the pressing part causes the arm to turn in a direction separating from the attachment position until the engagement part escapes from the engagement recess to the introduction part when the lock lever is turned in the other direction from the engagement position against the biasing force of the turn biasing means.

It is preferred that the lock lever is turn biased further in the above-mentioned one direction from the lock position by the turn biasing means, and the lock part is caused to push the other end part of the arm in the direction approaching the other end part of the base part by the biasing force of the turn biasing means, so that the engagement part is pressed against the bottom part of the engagement recess.

It is also preferred that a lock retaining means is disposed between one of the base part and the arm and the lock lever, the lock retaining means being adapted to prevent the lock lever from turning in the other direction from the lock position against the biasing force of the turn biasing means.

Preferably, the lock retaining means is a turning member turnably disposed at the arm such that one end part of the lock retaining means is movable between the lock position and the unlock position, when the turning member is turned to the lock position, the other end part of the turning member is engaged with the lock lever located in the lock position to prevent the lock lever from turning in the other direction from the lock position, and when the turning member is turned to the unlock position, the other end part of the turning member is separated from the lock lever located in the lock position to allow the lock lever to turn in the other direction from the lock position. It is also an interesting alternative that the lock retaining means is a movable member movably disposed at the base part such that the movable member is lineally movable between the lock position and the unlock position, when the movable member is moved to the lock position, the movable member is engaged with the lock lever located in the lock position to prevent the lock lever from moving in the other direction from the lock position, and when the movable member is moved to the unlock position, the movable member is separated from the lock lever located in the lock position to allow the lock lever to turn in the other direction from the lock position.

BRIEF DESCRIPTION OF DRAWINGS

FIG. 1(A) is a front view thereof, FIG. 1(B) is a plan view thereof, and FIG. 1(C) is a front sectional view thereof.

FIG. 2(A) is a front view thereof, and FIG. 2(B) is a front sectional view thereof.

FIG. 3(A) is a front view thereof, and FIG. 3(B) is a front sectional view thereof.

FIG. 4(A) is a front view thereof, and FIG. 4(B) is a front sectional view thereof.

FIG. 8(A) is a front view thereof, FIG. 8(B) is a sectional view taken on B—B of FIG. 8(A), FIG. 8(C) is a plan view thereof, and FIG. 8(D) is a perspective view thereof.

FIG. 9(A) is a perspective view thereof, FIG. 9(B) is a front view thereof, FIG. 9(C) is a side view thereof, and FIG. 9(D) is a plan view thereof.

FIG. 10(A) is a perspective view thereof, FIG. 10(B) is a front view thereof, FIG. 10(C) is a plan view thereof, and FIG. 10(D) is a side view thereof.

FIG. 11(A) is a perspective view thereof, FIG. 11(B) is a front view thereof, FIG. 11(C) is a plan view thereof, and FIG. 11(D) is a side view thereof.

FIG. 12(A) is a perspective view thereof, FIG. 12(B) is a plan view thereof, and FIG. 12(C) is a front view thereof.

FIG. 13(A) is a front view thereof, FIG. 13(B) is a pan view thereof, and FIG. 13(C) is a front sectional view thereof.

FIG. 14(A) is a front view thereof, and FIG. 14(B) is a front sectional view thereof.

FIG. 15(A) is a front view thereof, and FIG. 15(B) is a front sectional view thereof.

BEST MODE FOR CARRYING OUT THE INVENTION

Figure 1:
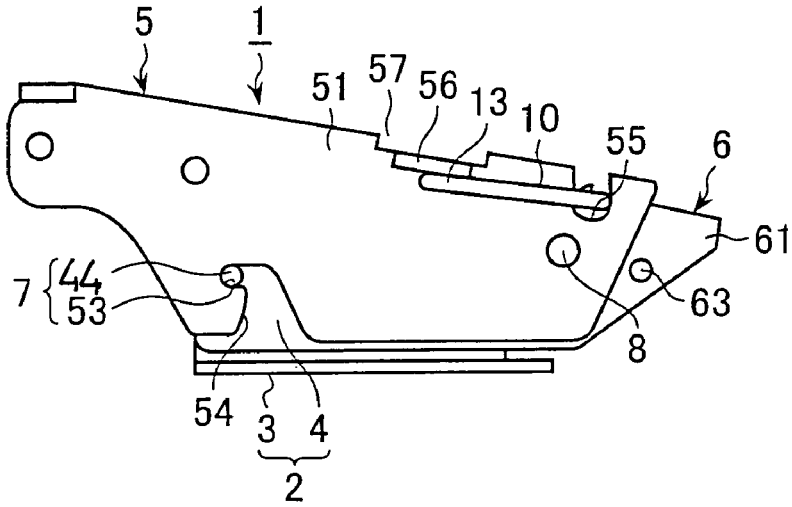
FIG. 1 is a view showing a first embodiment of the present invention in which an arm is attached to a base part and a lock retaining member is turned to an unlocking prevention position.
Figure 1:
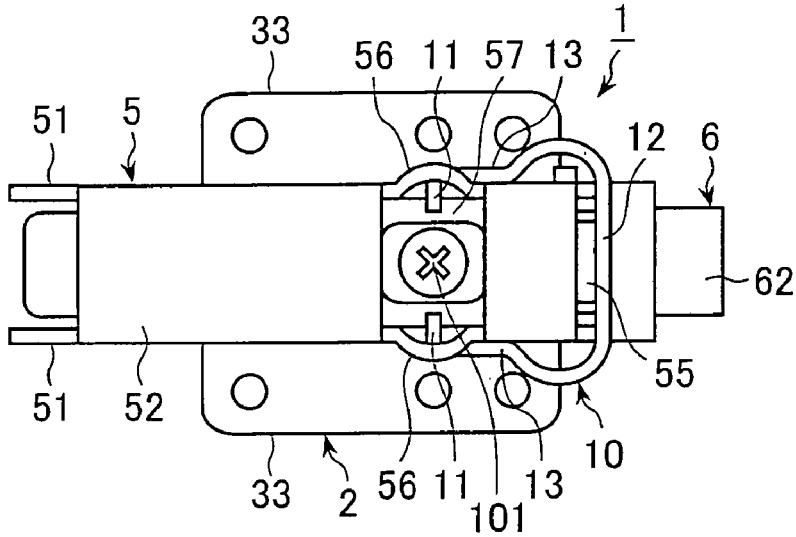
Figure 1:
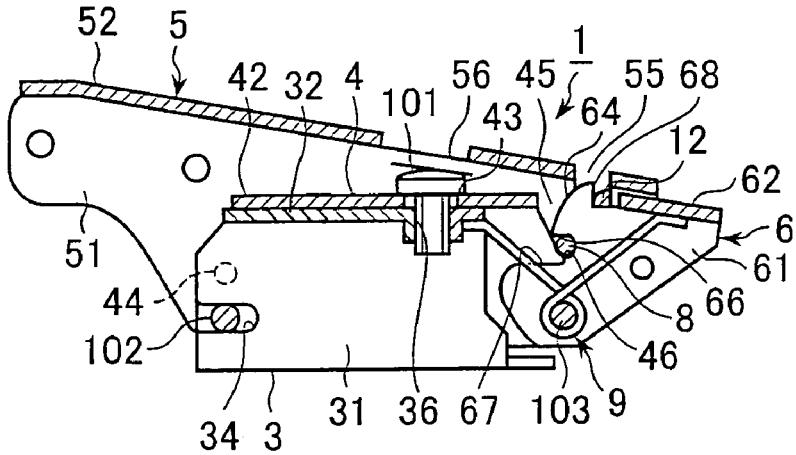

Embodiments of the present invention will be described hereinafter with reference to FIGS. 1 through 16.

FIGS. 1 through 12 shows a first embodiment of the present invention. As shown in FIGS. 1 through 7, a hinge 1 of this embodiment comprises, as known one, a base part 2 and an arm 5. The base part 2 is attached to the inner surface of a side wall of a skeleton (not shown) such as a wardrobe or the like with its longitudinal direction placed in the horizontal direction. The arm 5 is removably attached to the base part 2 and also turnably connected to a door for opening and closing an opening port of the skeleton.

Figure 7:
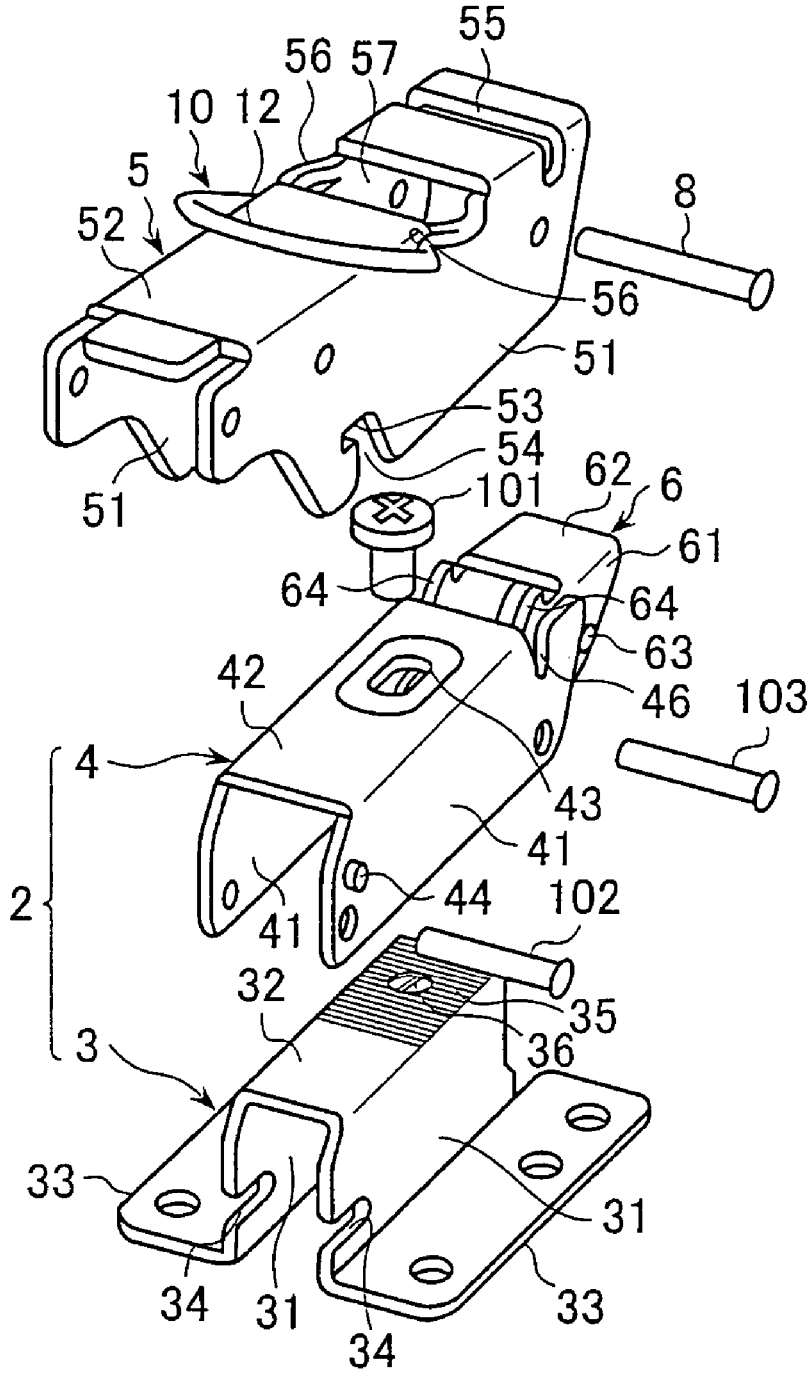
FIG. 7 is an exploded perspective view likewise showing the first embodiment of the present invention.
Figure 8:
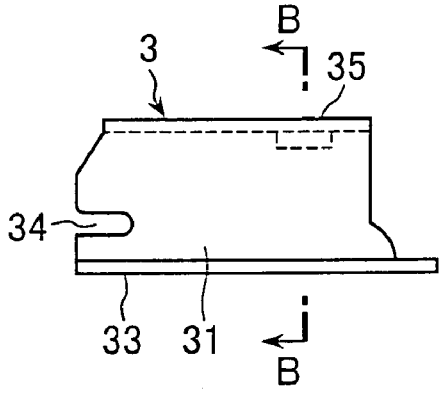
FIG. 8 is a view showing a fixing member of the base part used in the first embodiment of the present invention.
Figure 8:
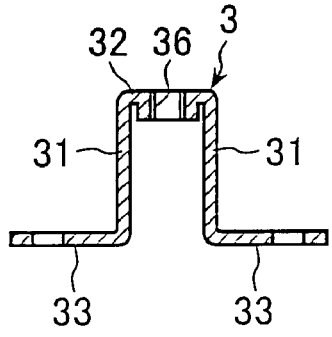
Figure 8:
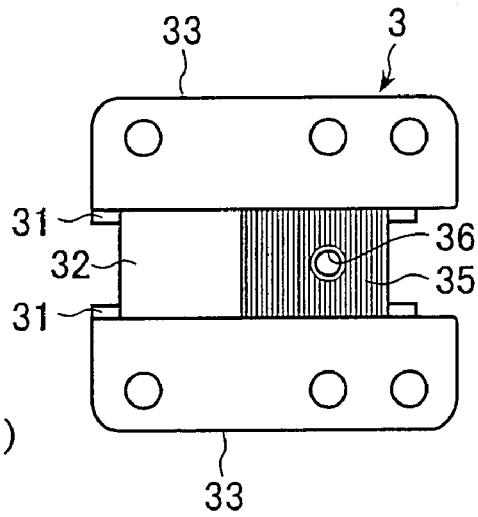
Figure 8:
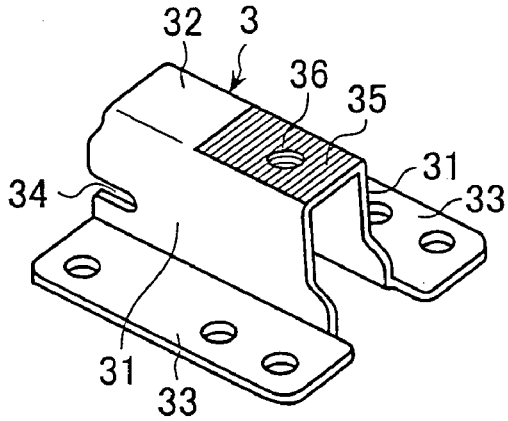

The base part 2 comprises a fixing member 3 and an adjustment member 4. The fixing member 3 comprises a pair of side plate parts 31, 31, a top plate part 32 suspended between upper end parts (hereinafter, "upper" and "lower" refer to the upper and lower in FIGS. 1 through 7) of the pair of side plate parts 31, 31, and a pair of attachment plate parts 33, 33 projecting from lower end parts of the side plate parts 31, 31 in the directions away from each other. The fixing member 3 is fixed at its attachment plate parts 33, 33 to the inner surface of a side wall of the skeleton with its longitudinal direction placed in the back and forth direction of the skeleton. Therefore, in a state in which the fixing member 3 is attached to the inner surface of the side wall of the skeleton, the side plate parts 31, 31 of the fixing member 3 are opposed to each other in the left and right directions (actually, up and down directions) of FIGS. 1 through 5. A groove 34 is formed in one end part (left end part in FIGS. 1 through 7, hereinafter referred to as the "distal end part"

and the other end part is referred to as the "basal end part") of each side plate 31 located on the opening part side of the skeleton. This groove 34 extends from the distal end face of each side wall part 31 toward the basal end side. As shown in FIGS. 7 and 8, a sinuated surface part 35 consisting of a plurality of ridges extending in a direction orthogonal to the longitudinal direction of the base part 2 is formed on a basal end part of the top plate part 32. A threaded hole 36 is formed in the sinuated surface 35 in such a manner as to penetrate the surface 35.

The adjustment member 4 is formed in a shape of a letter "U" in section by a pair of side plate parts 41, 41 and a top plate part 42 suspended between the upper end parts of the pair of side plate parts 41, 41. The side plate parts 31, 31 and the top plate part 32 of the fixing member 3 are inserted in the inside of the adjustment member 4 through an opening part in the lower side. An elongate hole 43 extending in the longitudinal direction of the base part 2 is formed in the top plate part 42 at its place corresponding to the threaded hole 36. A fixing bolt 101 is inserted in this elongate hole 43 and threadingly engaged with the threaded hole 36. So, by tightening the bolt 101, the top plate part 42 is fixed to the top plate part 32 and thus, the adjustment member 4 is fixed to the fixing member 3. Moreover, a sinuated surface part (not shown) consisting of a plurality of ridges similar to those consisting the sinuated surface part 35 is formed on a lower surface of the top plate part 42 at its place corresponding to the sinuated surface part 35. By bringing this sinuated surface part into abutment with the sinuated surface part 35, the adjustment member 4 is fixed to the fixing member 3 in such a manner as being unable to move in the longitudinal direction of the base part 2. It should be noted that the position of the adjustment member 4 in the longitudinal direction of the base part 2 is adjustable in a range of the length of the elongate hole 43 by untightening the bolt 101. The position of the adjustment member 4 in a direction (up and down direction of the skeleton) orthogonal to the side plate 42 of the adjustment member 4 is restricted by abutment of the inner surfaces of the side plates 41, 41 with the outer surfaces of the side plates 31, 31.

A reinforcement pin 102 is suspended between the distal end parts of the side plate parts 41, 41. By this reinforcement pin 102, the adjustment member 4 is reinforced such that the interval between the side plate parts 41, 41 is maintained constant. The reinforcement pine 102 is inserted in the groove 34 in such a manner as to be movable in the longitudinal direction of the base part 2. Accordingly, the reinforcement member 102 does not interfere the adjustment member 4 at the time of adjusting the adjustment member 4 in position in its longitudinal direction (longitudinal direction of the base part 2). A support pin 103 with its axis placed in a direction orthogonal to the side plate part 41 is suspended between the rear end parts of the side plate parts 41, 41. Through this support pin 103, a lock lever 6 is turnably supported by the rear end parts of the side plate parts 41, 41. This lock lever 6 will be described later.

Figure 3:
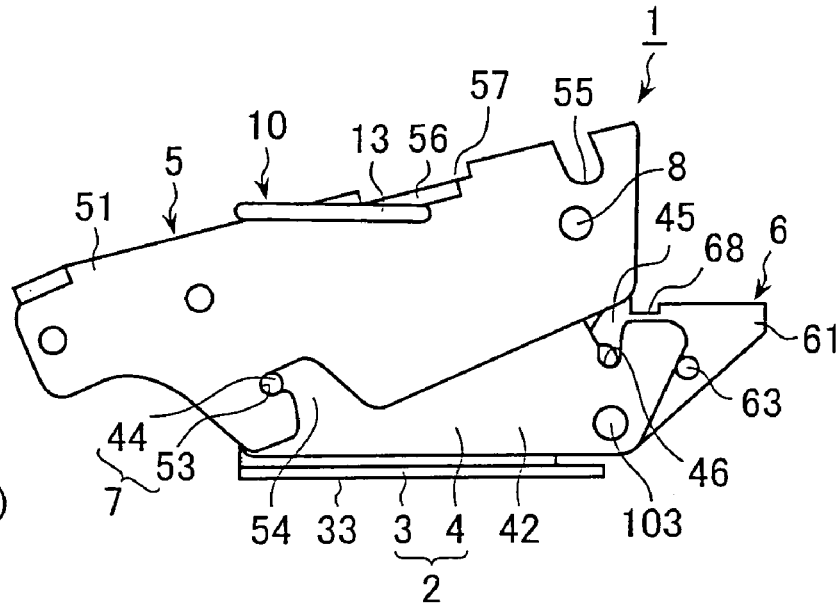
FIG. 3 is a view likewise showing the first embodiment of the present invention but in which a distal end part of an arm is turnably connected to a distal end part of a base part.
Figure 3:
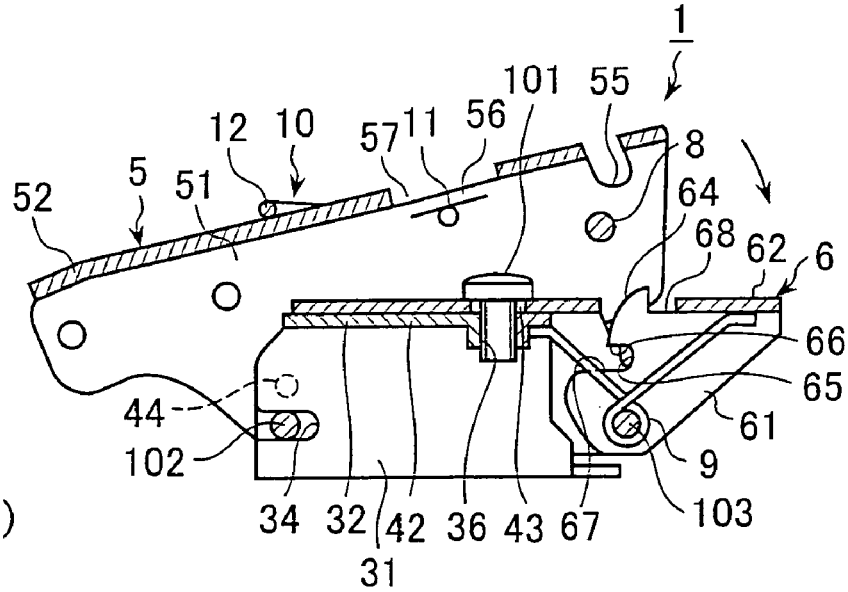
Figure 4:
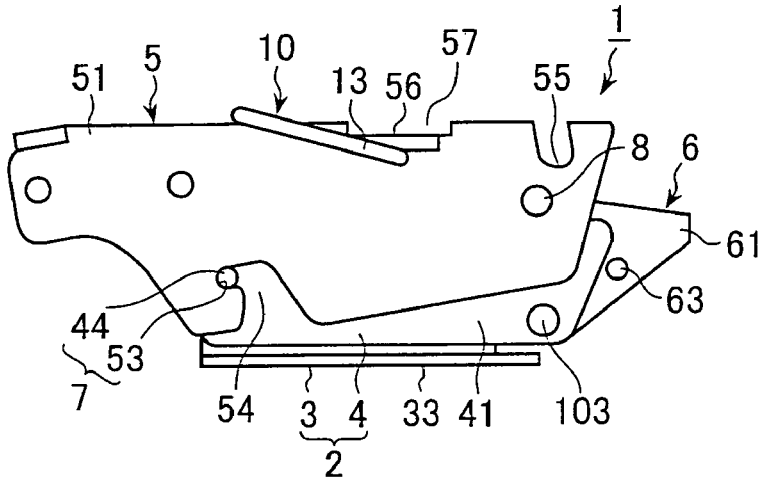
FIG. 4 is a view likewise showing the first embodiment of the present invention but in which an engagement pin is abutted with a lock lever.
Figure 4:
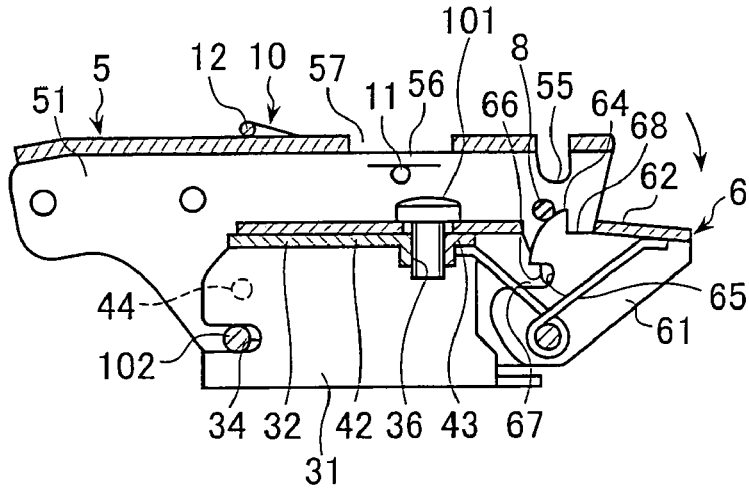

The arm 5 is formed in a shape of a letter "U" in section by a pair of side plate parts 51, 51 and a top plate part 52 suspended between the upper end parts of the pair of side plate parts 51, 51. The top plate part 42 and the side plate parts 41 of the adjustment member 4 constituting the base part 2 can be inserted in the inside of the arm 5 through an opening part in the lower side. The distal end part of the arm 5 and the distal end part of the adjustment part 4 are turnably connected to each other through a connection mechanism 7. That is, projection pin parts (connection pin parts) 44 each having a circular shape in section and projecting in a direction orthogonal to the side plate part 42 are formed on the outer faces of the distal ends of the side plates 41, 41 of the adjustment member 4, respectively, with their axes aligned with each other. Those two projection pin parts 44, 44 may be constituted by opposite end parts of a single pin member penetrating the side plate parts 41, 41. A support hole (support recess) 53 extending in the longitudinal direction of the arm 5 is formed on the distal end side of the side plate part 51 of the arm 5. A rear end part of the support hole 53 is open to a lower surface of the side plate part 51 through an opening groove 54. As shown in FIGS. 1 and 3, by inserting the projection pin part 44 in the support hole 53 through the opening groove 54, the distal end part of the arm 5 is turnably connected to the distal end part of the adjustment member 4 (base part 2). When the arm 5 is turned in a direction as indicated by an arrow of FIG. 3(B), its rear end part is brought toward the rear end part of the base part 2, and when the arm 5 is turned in the opposite direction, its rear end part is brought away from the base part 2. Moreover, by abutting the projection pin part 44 with the distal end side of the support hole 53, the distal end part of the arm 5 is connected to the distal end part of the adjustment member 4 such that the arm 5 is non-movable backward and also non-movable in directions (left and right directions of the skeleton) orthogonal to the top plate parts 42, 52.

Figure 2:
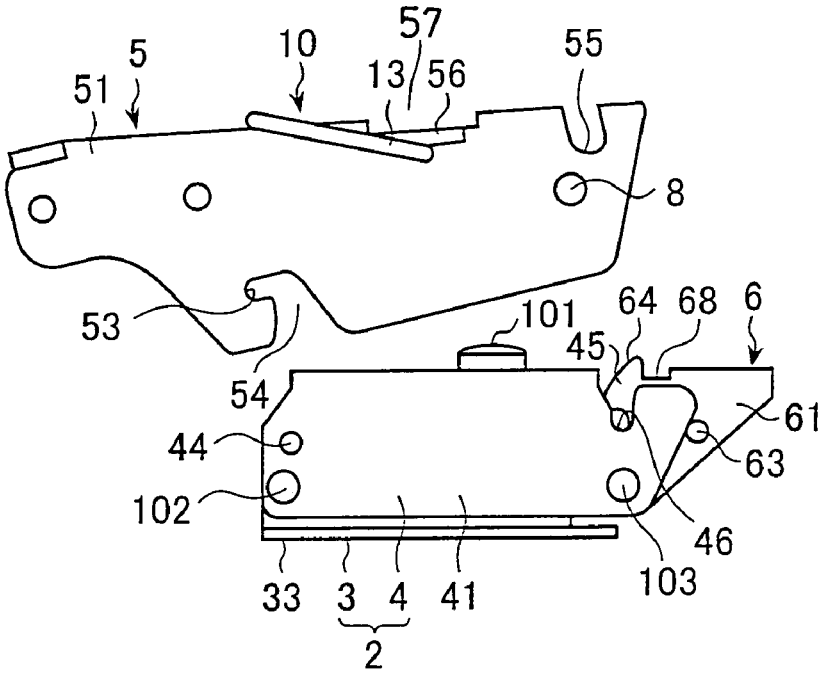
FIG. 2 is a view likewise showing the first embodiment of the present invention but in which an arm is not yet attached to a base part.
Figure 2:
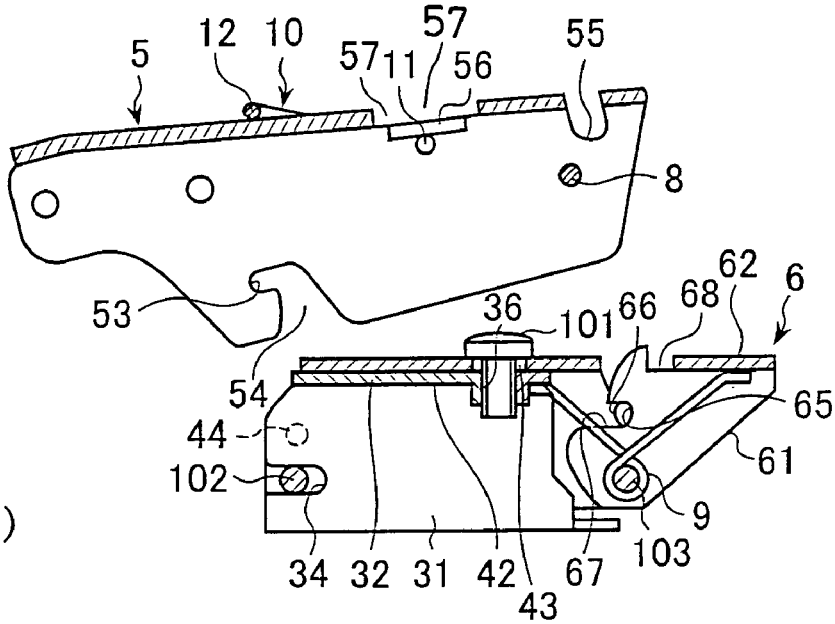
Figure 9:
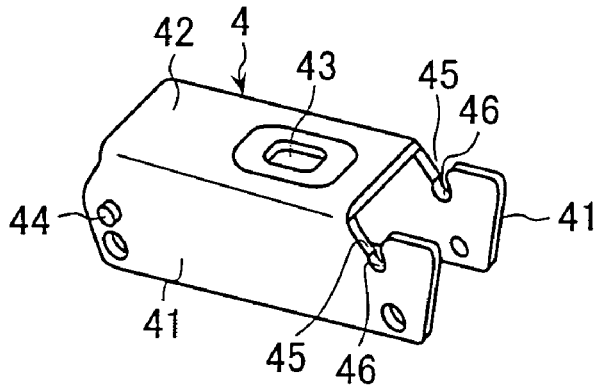
FIG. 9 is a view showing an adjustment member of the base part used in the first embodiment of the present invention.
Figure 9:
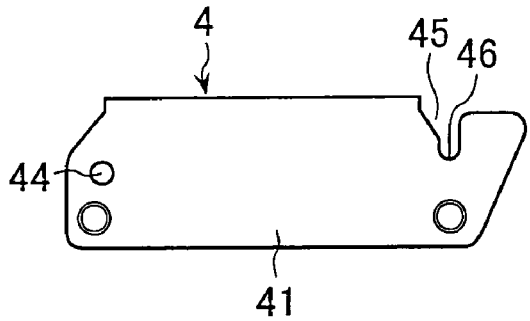
Figure 9:
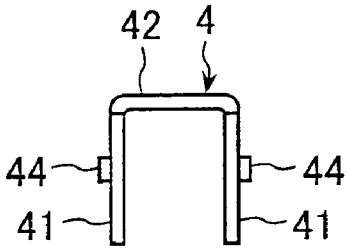
Figure 9:
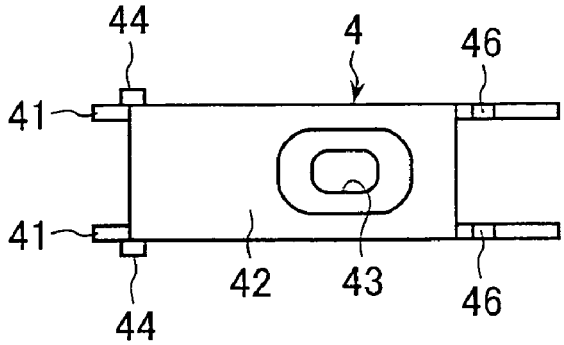
Figure 10:
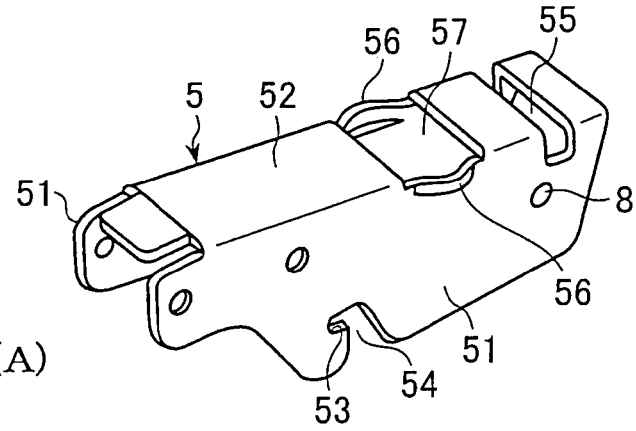
FIG. 10 is a view showing an arm used in the first embodiment of the present invention.
Figure 10:
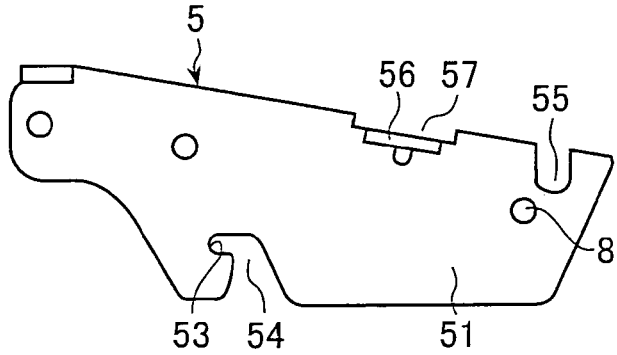
Figure 10:
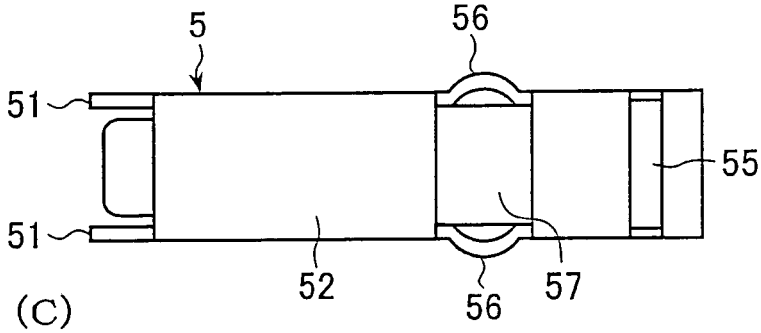
Figure 10:
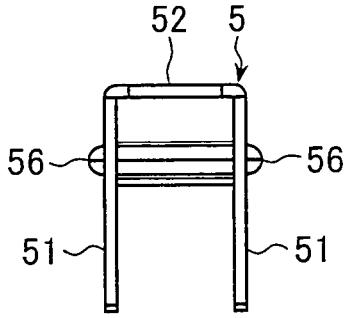
Figure 11:
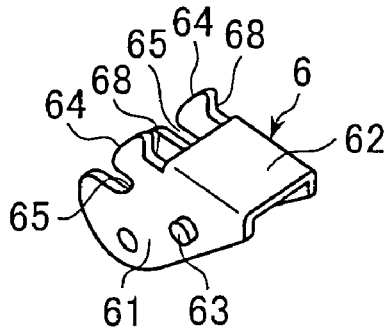
FIG. 11 is a view showing a lock lever used in the first embodiment of the present invention.
Figure 11:
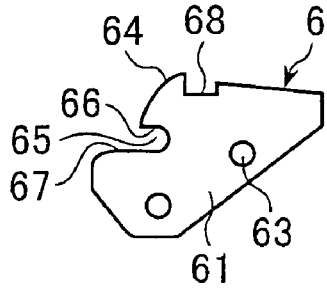
Figure 11:
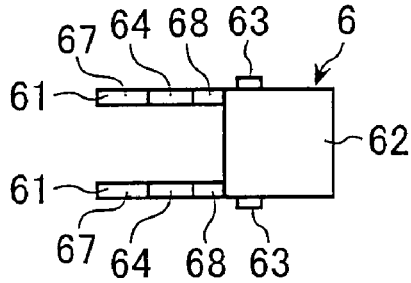
Figure 11:
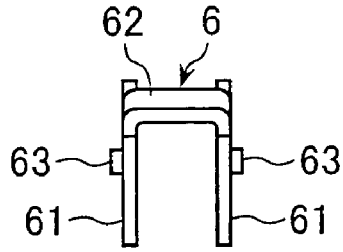

An engagement pin (engagement part) 8 having a circular shape in section is suspended between the rear end parts of the side plate parts 51, 51 of the arm 5. The engagement pin 8 is arranged parallel to the projection pin part 44. As shown in FIGS. 2, 3 and 9, an opening recess (introduction part) 45 is formed in an upper surface of each side plate part 41 of the adjustment member 4. This opening recess 45 is arranged opposite to the engagement pin 8. An engagement recess 46 is formed in a bottom part of the opening recess 45. The open recess 45 and the engagement recess 46 are arranged such that when the arm 5 is turned in a direction (approaching direction to the base part 2) as indicated by an arrow of FIG. 3 with the projection pin part 44 butted with the distal end part of the support hole 53, the engagement pin 8 is brought into the recess 46 via the open recess 45 until the pin 8 is butted with the bottom surface of the engagement recess 46. The engagement recess 46 is set to be generally equal in width in the longitudinal direction of the base part 2 to the outside diameter of the engagement pin 8. Therefore, in a state in which the engagement pin 8 is brought in the engagement recess 46, the arm 5 becomes unable to move in the longitudinal direction of the base part 2. On the other hand, the side surface of the open recess 45 located on the distal end side of the base part 2 is inclined forward of the base part 2 as it is separated upward from the engagement recess 46, so that the width of the open recess 45 in the longitudinal direction of the base part 2 is gradually enlarged upward (top plate part 42 side) from the engagement recess 46. As a result, the width of the open recess 45 in the longitudinal direction of the base part 2 is larger than the outside diameter of the engagement pin 8. Therefore, when the engagement pin 8 is brought into the open recess 45 after it is disengaged from the engagement recess 46, it can move forward of the base part 2. The arm 5 can also move forward of the base part 2 by a portion the engagement pin 8 can move forward of the base part 2. When the arm 5 is moved forward of the base part 2, the projection pin part 44 is moved to the rear end side of the support hole 53, so that it can escape from the support hole 53 via the open groove 54. The open recess 45 may be tapered by inclining its side surface located on the base end side of the base part 2 in the opposite direction to the side surface located on the distal end side of the base part 2.

The lock lever 6 includes, as shown in FIGS. 1 through 7 and FIG. 11, a pair of side plate parts 61, 61, and a top plate part 62 suspended between the upper parts of the side plate parts 61, 61. The lock lever 6 is formed in a shape of a letter "U" in section. The lower parts on the distal end side of the side plate parts 61, 16 are inserted between the side plate parts 41, 41 of the adjustment member 4. The side plate parts 61, 61 are turnably supported by the side plate parts 41, 41 through the support pin 103 arranged parallel to the axis of the projection part pin 44. A coiled spring (turn biasing means) 9 is wound around the support pin 103. By this coiled spring 9, the lock lever 6 is turn biased counterclockwise (one direction) in FIGS. 1 through 5. A lock projection 63 is formed on the outer surface of each side plate part 61 of the lock lever 6 in such a manner as to project in a direction (parallel direction to the support pin 103) orthogonal to the outer surface. As shown in FIG. 2(A), when the respective lock projections 63 (only one lock projection 63 is shown) are butted with the basal end surfaces of the side plates 41 of the adjustment member 4, the lock lever 6 is unable to turn counterclockwise any further. The turn position of the lock lever 6 at that time is hereinafter referred to as the "standby position".

A cam face 64 is formed on the upper part on the distal end side of each side plate part 61 of the lock lever 6. This cam face 64 is arranged such that when the arm 5 is turned in such a manner as to allow its rear end part to approach the base part 2 under the condition that the lock lever 6 is in the standby position, the engagement pin 8 is butted with the arm 5. Moreover, when the arm 5 is further approachingly turned under the condition that the engagement pin 8 is butted with the cam face 64, the cam face 64 turns the lock lever 6 clockwise (other direction) against the biasing force of the coiled spring 9. Accordingly, when the arm 5 is turned in a direction as indicated by an arrow of FIG. 3 about the projection pin part 44 fitted to the distal end part of the support hole 53, the lock lever 6 is automatically turned clockwise by the engagement pin 8. When the engagement pin 8 reaches a position immediately before it is butted with the bottom surface of the engagement recess 46, the engagement pin 8 moves over the cam face 64. Then, the lock lever 6 is turned counterclockwise by the biasing force of the coiled spring 9.

A recess 65 extending horizontally backward is formed in a part continuing to the lower side from the cam face 64 of each side plate part 61 of the lock lever 6. Of the entire surface defining the recess 65, an upper side surface serves as a lock part 66, and a lower side surface serves as a pressing part 67. When the lock lever 6 is turned counterclockwise by the coiled spring 9 after the arm 5 is approachingly turned and the engagement pin 8 moves over the cam face 64, the lock part 66 is butted with the upper part of the outer peripheral surface of the engagement pin 8 and pushes the engagement pin 8 downward. Then, as shown in FIG. 1(C), the engagement pin 8 is caused to be butted with the bottom part of the engagement recess 46 by the lock part 66. Accordingly, the arm 5 is not moved in such a manner as to be separated upward from the base part 2 unless the lock lever 6 is turned clockwise against the biasing force of the coiled spring 9. Of course, since the engagement pin 8 is brought into the engagement recess 46, the arm 5 is prevented from moving in the longitudinal direction of the base part 2. Moreover, since the projection pin part 44 is fitted into the support hole 53, the distal end part of the arm 5 is prevented from moving in the up and down directions. By this, the arm 5 is fixedly attached to the base part 2.

The turn position of the arm 5 at the time the engagement pin 8 is butted with the bottom surface of the engagement recess 46 is the attachment position, and the turn position of the lock lever 6 at the time the lock part 66 causes the engagement pin 8 to be butted with the bottom part of the engagement recess 46 is the lock position. When the lock lever 6 is located in the lock position, the lock projection 63 is slightly separated backward from the basal end face of the side plate 41 of the adjustment member 4. Therefore, when the lock lever 6 is located in the lock position, it biases the engagement pin 8 downward so as to be pressed against the lower surface of the engagement recess 46. By this, the arm 5 is held in the attachment position with no play.

Figure 5:
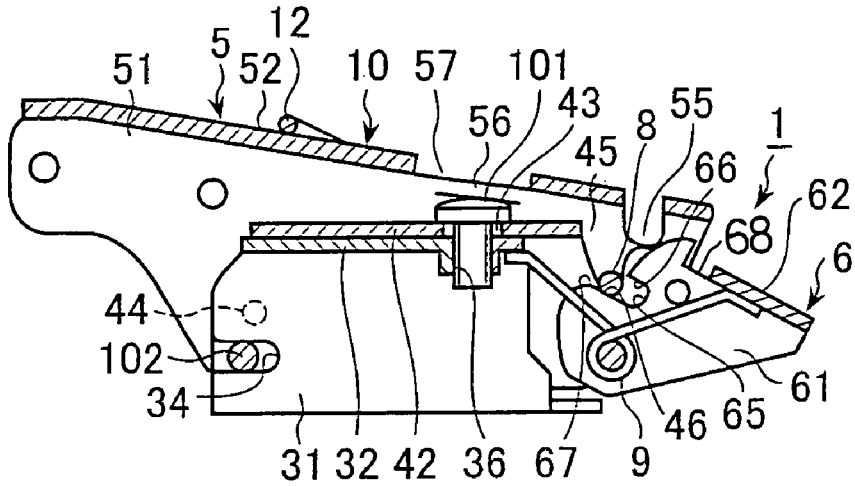
FIG. 5 is a front sectional view likewise showing the first embodiment of the present invention but in which an engagement pin is pushed up by a lock lever.
Figure 6:
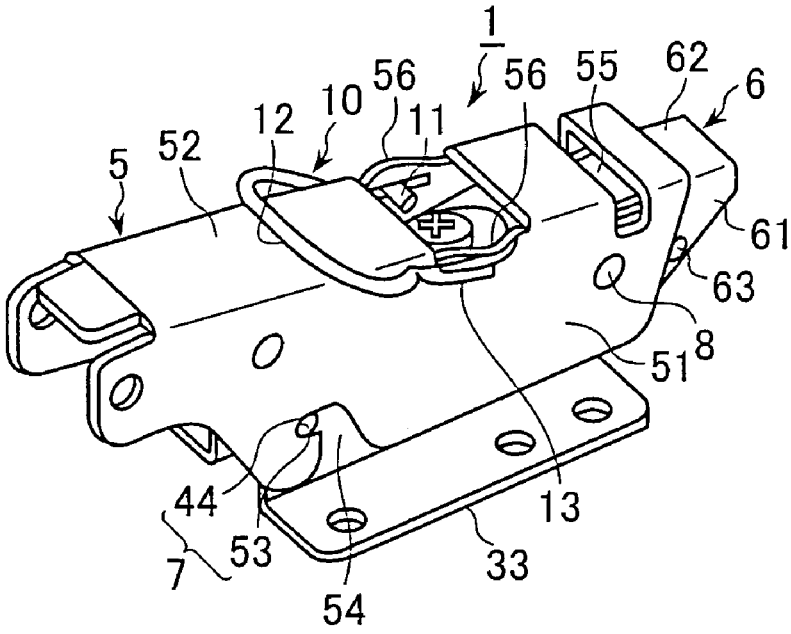
FIG. 6 is a perspective view likewise showing the first embodiment of the present invention but in which an arm is attached to a base part, and a lock retaining member is turned to an unlocking allowing position.

When the arm 5 is located in the attachment position, the most part on the basal end side of the top plate part 62 of the lock lever 6 is projected backward from the top plate part 52 of the arm 5. By pushing the projecting part of the top plate part 62 downward, the lock lever 6 can be turned clockwise against the biasing force of the coiled spring 9. Therefore, the top plate part 62 has a function as a handle for turning the lock lever 6 clockwise. When the lock lever 6 is turned clockwise from the lock position, as shown in FIG. 5, the pressing part 67 pushes the lower part of the outer peripheral surface of the engagement pin 8 upward. The pressing part 67 has such a dimension as being able to push and move the engagement pin 8 upward until at least the center (axis) of the engagement pin 8 is projected upward from the engagement recess 46. Particularly, in this embodiment, the pressing part 67 has such a sufficient dimension (length in the longitudinal direction of the base part 2) as to cause the entire engagement pin 8 to escape to the open recess 45 from the engagement recess 46.

When the lock lever 6 is turned clockwise by mistake under the condition that the arm 5 is turned to the attachment position and attached to the base part 2, the arm 5 can be removed from the base part 2. If the arm 5 should be removed from the base part 2, the door would be detached from the skeleton. In order to prevent such an undesirable occurrence, in this hinge 1, a lock retaining member (turn member) 10 is used as the lock retaining means between the arm 5 and the lock lever 6.

Figure 12:
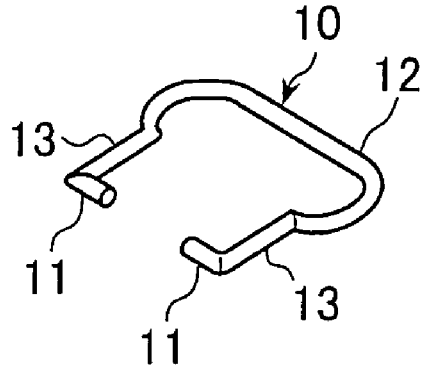
FIG. 12 is a view showing a lock retaining member used in the first embodiment of the present invention.
Figure 12:
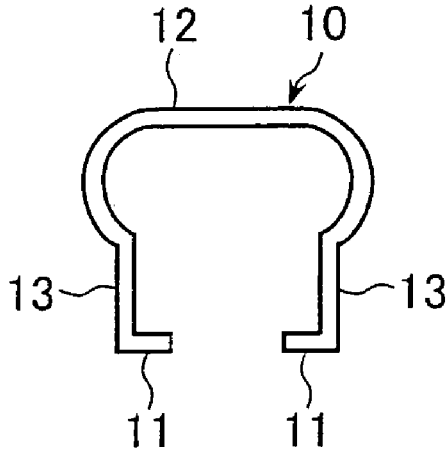
Figure 12:
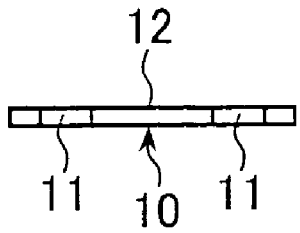

The lock retaining member 10 is adapted to retain the lock lever 6 in the lock position. As shown in FIG. 12, the lock retaining member 10 is formed generally in a shape of a letter "U" as a whole from a metal rod having a rigid property and a resilient property and having a circular shape in section such as steel or the like. Pin parts 11, 11 with axes thereof aligned with each other are formed on the opposite end parts of the lock retaining member 10. Each pin part 11 is arranged with its axis placed in a direction orthogonal to the side plate part 51 of the arm 5. Each pin part 11 penetrates the side plate part 51 from its outer surface side toward its inner surface side at its intermediate part in the longitudinal direction of the side plate 51 and at its slightly lower side from its upper end. The pin 11 is turnable and movable in the axial direction of the pin part 11. By this, the lock retaining member 10 is turnably connected to the arm 5 about the pin part 11.

The lock retaining member 10 is provided at an intermediate part thereof with an engagement pin part 12 extending parallel to the pin part 11. As shown in FIGS. 1 through 7 and FIG. 10, a cross groove 55 traversing the top plate part 52 is formed in the rear end part of the top plate part 52 of the arm 5. The bottom part of this cross groove 55 reaches a place (generally the same place as the pin part 11 in the up and down directions of the side plate part 51) slightly on the lower side from the upper end of the side plate part 51. The cross groove 55 is arranged such that when the lock retaining member 10 is turned clockwise in FIGS. 1 through 5 about the pin part 11, the engagement pin part 12 is brought into the cross groove 55. When the lock retaining member 10 is viewed in a direction orthogonal to the side plate part 61 at the time the engagement pin part 12 is brought into the cross groove 55 until it is butted with the bottom part of the groove 55, as shown in FIG. 1, the lock retaining member 10 is generally parallel to the top plate part 52. The position of the lock retaining member 10 at that time is hereinafter referred to as the "lock retaining position".

As shown in FIGS. 1 through 6 and FIG. 11, a lock groove 68 is formed in the upper end part of the side plate part 61 of the lock lever 6. This lock recess 68 is arranged such that when the arm 5 is located in the attachment position and the lock lever 6 is located in the lock position, the lock recess 68 is in an opposing relation with the cross groove 55. Moreover, the lock recess 68 is arranged such that when the lock retaining member 10 is turned toward the lock retaining position side, the engagement pin part 12 is brought into the lock recess 68 and butted with the bottom part of the lock recess 68 at a position immediately before the lock retaining position. When the lock lever 6 is turned clockwise with the engagement pin part 12 brought in the lock recess 68, the side surface of the lock recess 68 facing the basal end side of the base part 2 is butted with the engagement pin part 12 so as to push the lock retaining member 10 to move toward the basal end side of the base part 2. However, since the pin part 11 is penetrated into the side plate part 51 of the arm 5, the lock retaining member 10 is prevented from moving toward the basal end side of the base part 2. Therefore, the lock lever 6 is prevented from turning clockwise by the lock retaining member 10.

Moreover, in this hinge 1, it is put into consideration that the lock retaining member 10 is prevented from easily escaping from the cross groove 55 and coming off the lock retaining position. To this end, as shown in FIGS. 1 through 7 and FIG. 10, a cam part 56 is formed on a part continuing to the upper side from a place of each side plate part 51 where the pin part 11 is turnably provided. This cam part 56 has an arcuate shape projecting outward when viewed in a direction orthogonal to the top plate part 52. The interval between the cam parts 56, 56 is smallest at the opposite end parts (opposite end parts in the longitudinal direction of the base part 2) and largest at the central part of the cam part 56. The central part of the cam part 56 is located at the same position as the pin part 11 in the longitudinal direction of the base part 2. Therefore, when the lock retaining member 10 is turned, the cam part 56 increasingly or decreasingly varies the interval between the parts (since those parts are generally parallel to the side plate part 51, they are hereinafter referred to as the "parallel parts") 13 continuously formed in such a manner as to be orthogonal to the pin parts 11, 11 of the lock retaining member 10 against the resilient force of the lock retaining member 10. As a result, when the parallel part 13 is located at the central part of the cam part 56, the lock retaining member 10 merely pushes the parallel part 13 against the cam part 56 by its own resilient force. However, when the parallel part 13 is displaced to one end on either side from the central part of the cam part 56 in accordance with turning motion of the lock retaining member 10, the resilient force of the lock retaining member 10 itself is converted into a turn biasing force by the cam part 56 and the lock retaining member 10 is turned by the biasing force to the side where the parallel part 13 is displaced. Therefore, when the parallel part 13 is displaced from the central part of the cam part 56 such that the engagement pin part 12 of the lock retaining member 10 moves toward the basal end side of the base part 2, the lock retaining member 10 is turned toward the lock retaining position. When the parallel part 13 is displaced in the opposite side from the central part of the cam part 56, as shown in FIG. 2, the lock retaining member 10 is turned to the unlock position where the pin part 12 is butted with the top plate part 52.

When the lock retaining member 10 is located in the lock retaining position, since the parallel part 13 is butted with the end part of the cam part 56 on the basal end side of the base part 2, the lock retaining member 10 is biased by the resilient force of the lock retaining member 10 itself such that the engagement pin part 12 is moved downward. Therefore, the engagement pin part 12 is pressed against the bottom part of the lock recess 68 of the lock lever 6 by the resilient force of the lock retaining member 10. By this, the lock retaining member 10 is held in a state in which the engagement pin part 12 is butted with the bottom part of the lock recess 68. When the lock retaining member 10 turned to the unlock position, the member 10 is also held such that the engagement pin part 12 is butted with the top plate part 52.

In the hinge thus constructed, in case the arm 5 is to be attached to the base part 2, as shown in FIG. 2, the adjustment member 4 is preliminarily fixed to the fixing member 3 by a fixing bolt 101. Of course, the longitudinal position of the adjustment member 4 with respect to the fixing member 3 is preliminarily properly adjusted. Moreover, the lock retaining member 10 is preliminarily turned to the unlock position. Then, as shown in FIG. 3, the distal end parts of the side plate parts 41, 41 and the top plate parts 42 of the adjustment member 4 are inserted between the distal end parts of the side plate parts 51, 51 of the arm 5, and the projecting pin part 44 is inserted to the rear end part of the support hole 53 through the open groove 54. Then, the arm 5 is moved toward the basal end side of the base part 2 to cause the projection pin part 44 to be butted with the end part on the distal end side of the support hole 53. Thereafter, the arm 5 is turned in a direction (approaching direction to the base part 2) as indicated by an arrow of FIG. 3(B) about the projection pin part 44. When the arm 5 is turned, by a proper angle, in the direction as indicated by the arrow, the engagement pin 8 is butted with the cam face 64 of the lock lever 6. When the arm 5 is further turned in the direction as indicated by the arrow, the engagement pin 8 is brought into the lock recess 46 through the open recess 45 while causing the lock lever 6 to turn clockwise against the biasing force of the coiled spring 9. When the engagement pin 8 reaches a position immediately before it is butted with the bottom part of the engagement recess 46, the engagement pin 8 moves over the cam face 64. Then, the lock lever 6 is turned counterclockwise by the coiled spring 9, and the lock part 66 of the lock lever 6 pushes the engagement pin 8 downward so that the pin 8 is pressed against the bottom part of the engagement recess 46. By this, as shown in FIG. 1, the arm 5 is attached to the base part 2. Thereafter, the lock retaining member 10 is turned to the lock retaining position from the unlock position. By this, the lock lever 6 can be prevented from accidentally turning clockwise.

In order to make it possible to adjust the position of the door in the longitudinal direction of the base part 2 by adjusting the position of the arm 5 in the same direction in a state in which the arm 5 is attached to the base part 2, as shown in FIGS. 1 through 5, and FIGS. 7 and 10, a window hole 57 is formed in a place opposing to the fixing bolt 101 of the top plate part 52 of the arm 5. By untightening by fixing bolt 101 by inserting a threaded tool such as a screw driver or the like through this window hole 57, the adjustment member 4 can be positionally adjusted in the longitudinal direction of the base part 2 in a state in which the arm 5 is attached to the base part 2. Of course, by tightening the fixing bolt 101 after positional adjustment, the adjustment member 4 is fixed to the fixing member 3 and the arm 5 is positionally fixed to the base part 2.

In case the arm 5 is to be removed from the base part 2, first, the lock retaining member 10 is turned to the unlock position from the lock retaining position. Next, the top plate part 62 of the lock lever 6 is pushed downward to turn the lock lever 6 clockwise against the biasing force of the coiled spring 9. Then, as shown in FIG. 5, the pressing part 67 of the lock lever 6 is butted with the lower part of the outer peripheral surface of the engagement pin 8 to lift it up. The engagement pin 8 is allowed to escape to the open recess 45 from the engagement recess 46. The width of the open recess 45 in the longitudinal direction of the base part 2 is larger than the outside diameter of the engagement pin 8. Therefore, when the engagement pin 8 is brought into the open recess 45, the engagement pin 8 becomes able to move in the longitudinal direction of the base part 2, and as a result, the arm 5 becomes able to move in the longitudinal direction of the base part 2. Subsequently, the arm 5 is moved to the front side from the basal end side of the base part 2, and the engagement pin 8 is moved to the rear end part of the support hole 53. Thereafter, by moving the entire arm 5 upward so as to be separated from the base part 2, the arm 5 can be removed from the base part 2.

As apparent from the above, in this hinge 1, when the lock lever 6 is turned clockwise at the time the arm 5 is removed from the base part 2, the pressing part 67 lifts up the engagement pin 8 so that the engagement pin 8 can automatically escape from the engagement recess 46. Therefore, there is almost no need for moving the basal end part of the arm 5 so as to be separated from the base part 2. It is good enough that the arm 5 is simply moved back and forth. Therefore, the arm 5 can easily be removed from the base part 2.

Figure 13:
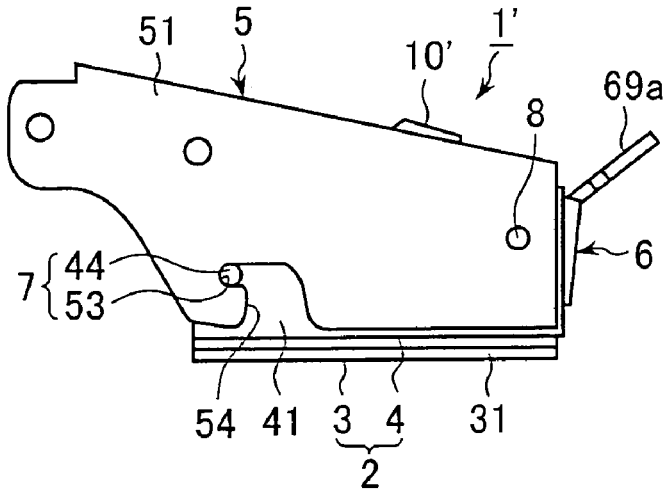
FIG. 13 is a view showing a second embodiment of the present invention in which an arm is attached to a base part, and a lock retaining member is moved to an unlocking prevention position.
Figure 13:
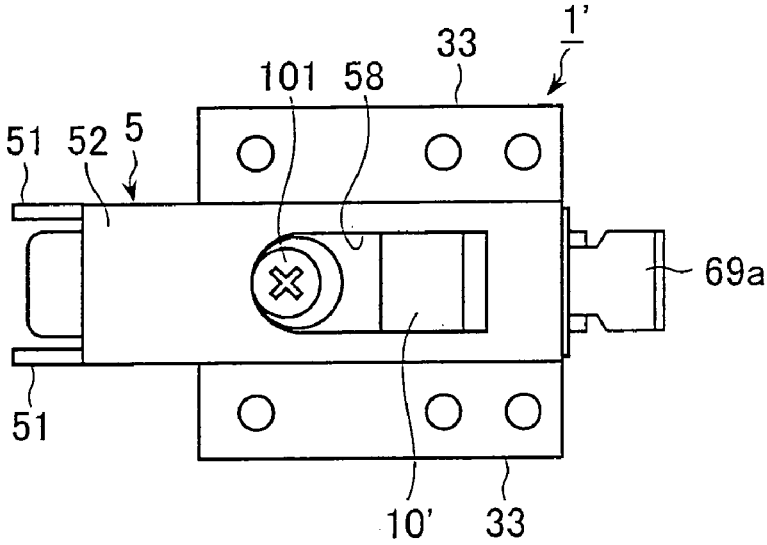
Figure 13:
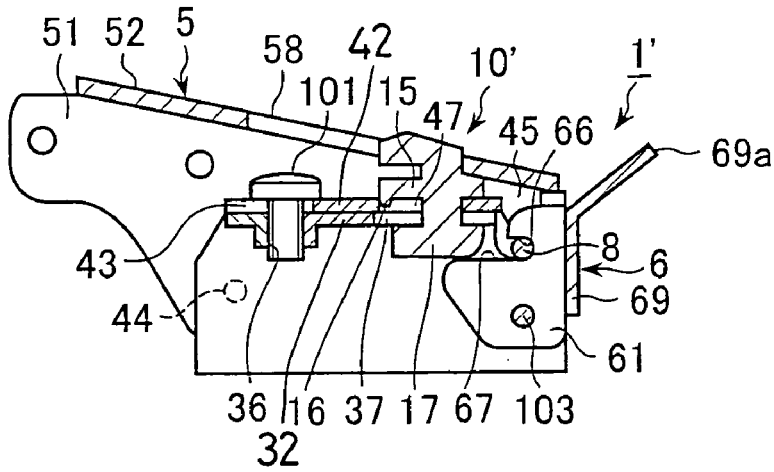
Figure 14:
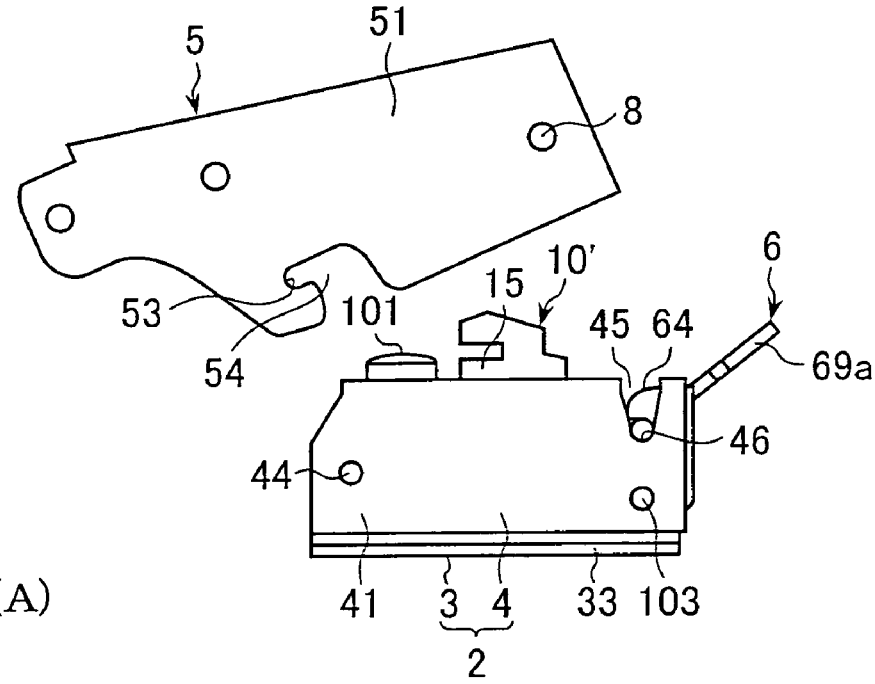
FIG. 14 is a view likewise showing the second embodiment of the present invention but in which an arm is not yet attached to a base part.
Figure 14:
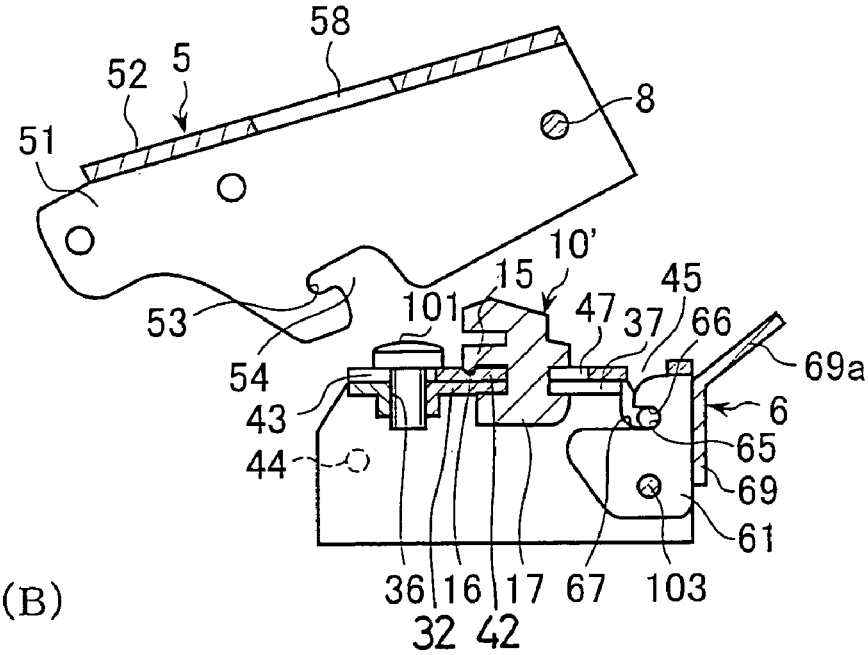
Figure 15:
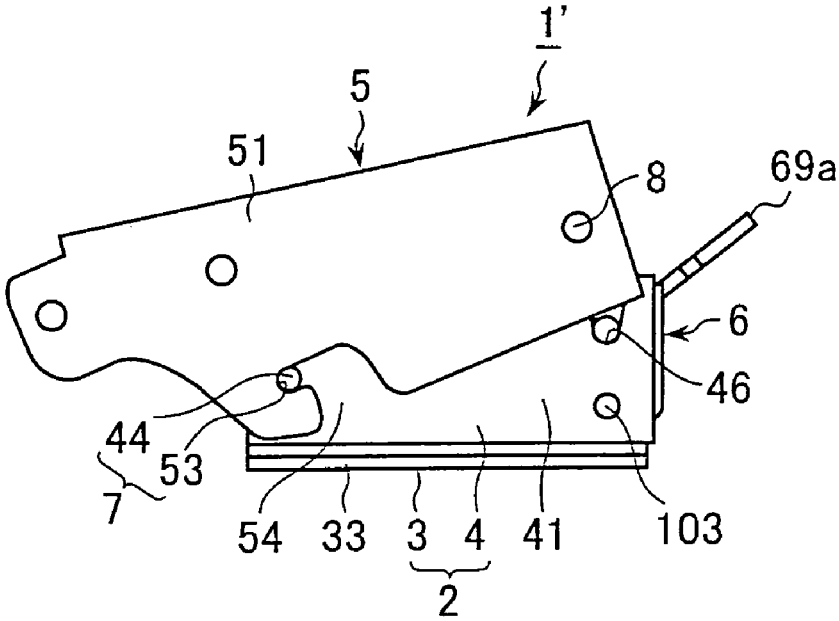
FIG. 15 is a view likewise showing the second embodiment of the present invention but in which a distal end part of an arm is turnably connected to a distal end part of a base part.
Figure 15:
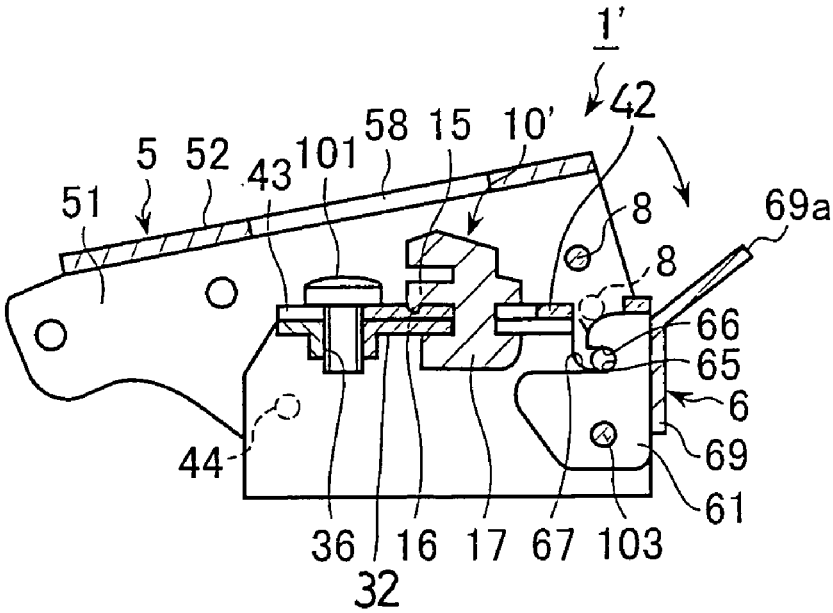

Next, a second embodiment of the present invention will be described with reference to FIGS. 13 through 15. Regarding this embodiment, only the construction different from that of the above embodiment is described and the identical component with those of the above embodiment is denoted by identical reference numeral and description thereof is omitted.

In a hinge 1' of this second embodiment, another lock retaining member (movable member) 10' is used instead of the lock retaining member 10 of the above embodiment. This lock retaining member 10' is mounted on the base part 2 so as to be movable in the longitudinal direction of the base part 2. That is, guide holes 37, 47 are formed in the top plate parts 32, 42 of the fixing member 3 and the adjustment member 4, respectively. The lock retaining member 10' is movably supported by the guide holes 37, 47 in the longitudinal direction of the base part 2. The lock retaining member 10' is movable between the lock retaining position shown in FIG. 13 and the unlock position shown in FIGS. 14 and 15. The lock retaining member 10' includes an elastic piece 15 extending to the distal end side of the base part 2. A projection 16 is formed on the lower surface of the distal end part of the elastic piece 15. When the lock retaining member 10' is located in the lock retaining position or in the unlock position, the projection 16 is fitted in one or the other of two recesses which are formed in the upper surface of the top plate part 42 in such a manner as to be away from each other in the back and forth direction. By this, the lock retaining member 10' is positionally fixed to the lock retaining position or to the unlock position with moderation.

The lock retaining member 10' includes an insertion part 17 which is generally contacted with the lower surface of the top plate part 32. When the lock retaining member 10' is moved to the lock retaining position in a state in which the lock lever 6 is turned to the lock position, as shown in FIG. 13, the insertion part 17 is brought between the top plate part 32 and the pressing part 67. The thickness of the insertion part 17 is set to be generally equal to the interval between the top plate part 32 and the pressing part 67. Therefore, when the lock lever 6 is turned clockwise against the biasing force of the coiled spring 9 (not shown in FIGS. 13 through 15) in a state in which the lock retaining member 10' is moved to the lock retaining position, the pressing part 67 is butted with the top plate part 32 through the insertion part 17. By this, the lock lever 6 is prevented from turning clockwise and the lock lever 6 is retained in the lock position.

In this hinge 1', since the guide holes 37, 47 are formed in the rear end parts of the top plate parts 32, 42, respectively and the lock retaining member 10' is provided, a threaded hole 36 and an elongate hole 43 are arranged on the distal end side of the top plate parts 32, 43, respectively. Moreover, in order to control the movement of the lock retaining member 10' in the back and force directions, a control hole 58 is formed in the top plate part 52 of the arm 5. The lock lever 6 comprises side plate parts 61, 61 and a back plate part 69 suspended between the basal end parts of the side plate parts 61, 61. The upper end part of the back plate part 69 extends slantwise upward and backward so as to define a handle part **69*a*. By pushing this handle part 69*a* downward, the lock lever 6 can be turned clockwise against the biasing force of the coiled spring 9**.

In this hinge 1', in case the arm 5 is to be attached to the base part 2, the lock retaining member 10' is preliminarily located in the unlock position. Then, as in the above embodiment, the arm 5 is attached to the base part 2. Thereafter, the lock retaining member 10' is moved to the lock retaining position. By this, the attachment of the arm 5 to the base part 2 is completed. In case the arm 5 is to be removed from the base part 2, the lock retaining member 10' is moved to the unlock position from the lock retaining position. Thereafter, the arm 5 can be removed from the base part 2 in the same manner as in the above embodiment.

Figure 16:
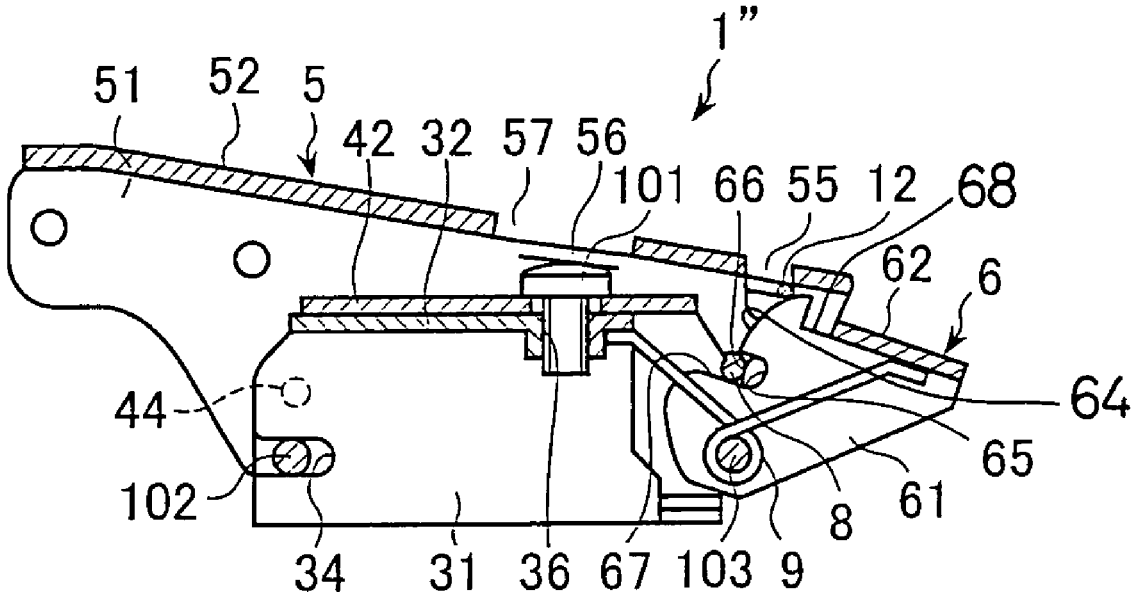
FIG. 16 is a front sectional view showing a third embodiment of the present invention in which an arm is being in a midst of operation to be attached to a base part.

FIG. 16 is a view showing a third embodiment of the present invention. A hinge 1" shown in this Figure is a modification of the hinge 1 of the first embodiment. The arm 5 can be attached to the base part 2 in a state in which the lock retaining member 10 is located in the lock retaining position. That is, when the arm 5 is turned toward the attachment position side in a state in which the lock retaining member 10 is located in the lock retaining position, the engagement pin 8 is butted with the can face 64 of the lock lever 6 to turn the lock lever 6 clockwise (other direction) against the biasing force of the coiled spring 9. When the engagement pin 8 moves over the cam face 64 downward, the lock lever 6 is turned counterclockwise (one direction) by the biasing force of the coiled spring 9. So far, the procedure is same as in the case with the above-mentioned hinge 1.

However, in this hinge 1", in the midst of turning movement of the lock lever 6 to the lock position in the counterclockwise direction caused by the biasing force of the coiled spring 9, the cam face 64 is butted with the engagement pin 12 of the lock retaining member 10. When the lock lever 6 is turned further toward the lock position side by the coiled spring 9, the cam face 64 causes the lock retaining member 10 to turn about the pin part 11 so that the engagement pin part 12 is moved upward, or resiliently deforms the lock member 10. When the lock lever 6 is turned in one direction until it reaches a position immediately before the lock position, the cam face 64 is separated from the engagement pin part 12 and the engagement pin part 12 opposes the lock recess 68. As a result, the engagement pin part 12 is brought into the lock recess 68 by the resilient force of the lock retaining member 10 itself. Thereafter, the lock lever 6 is turned to the lock position. On the other hand, when the lock retaining member 10 is turned to a position immediately before the lock retaining position, it stops movement because the engagement pin part 12 is butted with the bottom surface of the lock recess 68. Therefore, in this hinge 1", there can be eliminated the labor for turning the lock retaining member 10 from the unlock position to the lock retaining position after the arm 5 is attached to the base part 2. It should be noted, however, that in case the arm 5 is to be removed from the base part 2, the lock retaining member 10 is turned to the unlock position from the lock retaining position. This procedure is same as in the case with the above-mentioned hinge 1.

The present invention is not limited to the above-mentioned embodiments. Instead, many changes and modifications can be made in accordance with necessity.

For example, in the above-mentioned embodiments, the base part 2 comprises two members, i.e., the fixing member 3 and the adjustment member 4. It is also accepted that the fixing member 3, for example, is used directly as the base part 2. In that case, the fixing member 3 is provided with the lock lever 6. Moreover, in the above-mentioned embodiments, the projection pin part 44 and the support hole 53 constituting the connection mechanism 7 are disposed at the adjustment member 4 of the base part 2 and the arm 5, respectively. It is also accepted that the projection pin part is disposed at the arm 5 and the support hole is disposed at the adjustment member 4.

Moreover, in the above-mentioned embodiments, the lock part 66 and the pressing part 67 of the lock lever 6 are butted with the engagement pin (engagement part) 8 which is disposed at the basal end part of the arm 5. It is also an interesting alternative that the lock part 66 and the pressing part 67 are butted with basal end part of the arm 5 instead of the engagement pin 8.

Moreover, in the hinge 1" of the third embodiment, the cam face 64 for turning the lock lever 6 against the biasing force of the coiled spring 9 at the time the arm 5 is turned toward the attachment position side is commonly used as a cam face for turning or resiliently deforming the lock retaining member 10 toward the unlock position side from the lock retaining position. It is also accepted that the cam face for turning or resiliently deforming the lock retaining member 10 toward the unlock position side from the lock retaining position is separately formed from the cam face 64.

INDUSTRIAL APPLICABILITY

A hinge according to the present invention can be used as a hinge for turnably connecting a skeleton such as a wardrobe or the like, and a door together.

The invention claimed is:

1. A hinge comprising:

a base part;

an arm;

a connection mechanism disposed between one end part of said base part and one end part of said arm;

a longitudinal direction that extends from said end part of said base part to an other end part of said base part, wherein the connection mechanism is adapted to turnably and removably, in an axial direction orthogonal to the longitudinal direction of said base part, connect one end part of said arm to one end part of said base part so that the other end part of said arm can approach or separate from the other end part of said base part;

a lock lever turnably disposed at the other end part of said base part; and a turn biasing means for turn-biasing said lock lever in one direction comprising, one of said other end parts of said base part and said arm which oppose each other in the axial direction orthogonal to the longitudinal direction of the base part being formed with an engagement recess which is open toward the other, wherein said other being provided with an engagement part which is brought into said engagement recess through the opening part of said engagement recess when said arm is turned to a predetermined attachment position in a direction approaching the other end part of said base part, wherein said lock lever being provided at one end part thereof with a lock part, wherein said lock part is brought into engagement with the engagement part of said arm in said attachment position, wherein said arm is prevented from turning in a direction away from said attachment position when said lock lever is turned to a predetermined lock position in said one direction by a biasing force of said turn biasing means, wherein said lock part being separated from the other end part of said arm to allow the other end part of said arm to turn in the separating direction so that said engagement part can escape from said engagement recess when said lock lever is turned in the other direction from said lock position, and wherein said lock lever being provided at one end part thereof with a pressing part, wherein said pressing part being butted with the other end part of said arm in said attachment position, to turn the other end part of said arm in a separating direction from the other end part of said base part so that said engagement part can escape from said engagement recess when said lock lever is turned in said other direction from said lock position against the biasing force of said turn biasing means.

2. A hinge according to claim 1, wherein said connection mechanism includes:

a support recess formed in one end part of one of said base part and said arm;

a connection pin part disposed at one end part of the other of said base part and said arm, wherein said support recess being disposed with the longitudinal direction of said support recess placed in the longitudinal direction of the above-mentioned one of said base part and said arm, and wherein said connection pin part being inserted in said support recess, through an opening part of said support recess, until said connection pin part reaches a bottom part of said support recess and turnably supported by the bottom part of said support recess, thereby turnably connecting one end part of said arm to one end part of said base part.

3. A hinge according to claim 1, wherein said engagement recess and said engagement part are set to be equal to each other in width in the longitudinal direction of said base part, so that when said engagement part is brought into said engagement recess, said arm is non-movably connected to said base part in the longitudinal direction of said based part.

4. A hinge according to claim 3, wherein the opening side end part of said engagement recess is connected with an introduction part for allowing said engagement part to be brought into said engagement recess when said arm is approachingly turned to said attachment position, and wherein the width of said introduction part in the longitudinal direction of said base part is set to be larger than the width of said engagement part in the same direction, so that said pressing part causes said arm to turn in a direction separating from said attachment position until said engagement part escapes from said engagement recess to said introduction part when said lock lever is turned in the other direction from said engagement position against the biasing force of said turn biasing means.

5. A hinge according to claim 3, wherein said lock lever is turn biased further in the above-mentioned one direction from said lock position by said turn biasing means, wherein said lock part pushes the other end part of said arm in the direction approaching the other end part of said base part caused by the biasing force of said turn biasing means, so that said engagement part is pressed against the bottom part of said engagement recess.

6. A hinge comprising:

a base part;

an arm;

a connection mechanism disposed between one end part of said base part and one end part of said arm;

a longitudinal direction that extends from said end part of said base part to an other end part of said base part, wherein the connector mechanism is adapted to turnably and removably connect one end part of said arm to one end part of said base part so that the other end part of said arm can approach or separate from the other end part of said base part;

a lock lever turnably disposed at the other end part of said base part; and a turn biasing means for turn-biasing said lock lever in one direction comprising, one of said other end parts of said base part and said arm which oppose each other in the axial direction orthogonal to the longitudinal direction of the base part being formed with an engagement recess which is open toward the other, wherein said other being provided with an engagement part which is brought into said engagement recess through the opening part of said engagement recess when said arm is turned to a predetermined attachment position in a direction approaching the other end part of said base part, wherein said lock lever being provided at one end part thereof with a lock part, wherein said lock part is brought into engagement with the engagement part of said arm in said attachment position, wherein said arm is prevented from turning in a direction away from said attachment position when said lock lever is turned to a predetermined lock position in said one direction by a biasing force of said turn biasing means, wherein said lock part being separated from the other end part of said arm to allow the other end part of said arm to turn in the separating direction so that said engagement part can escape from said engagement recess when said lock lever is turned in the other direction from said lock position, wherein a lock retaining means is disposed between one of said base part and said arm and said lock lever, and wherein said lock retaining means is adapted to engage with a lock part disposed on the lock lever, preventing said lock lever from turning in the other direction from said lock position against the biasing force of said turn biasing means.

7. A hinge according to claim 6, wherein said lock retaining means is a turning member turnably disposed at said arm such that one end part of said lock retaining means is turnable between a lock retaining position and an unlock position, when said turning member is turned to said lock retaining position, the other end part of said turning member is engaged with said lock lever in said lock position to prevent said lock lever from turning in the other direction from said lock position, and when said turning member is turned to said unlock position, the other end part of said turning member is separated from said lock lever located in said lock position to allow said lock lever to turn in the other direction from said lock position.

8. A hinge according to claim 7, wherein said arm has a cam part formed thereon, said turning member is butted with said cam part by its own resilient force, said cam part converts the resilient force of said turning member to a turn biasing force, and said turning member is biased by this turn biasing force toward the lock retaining position from the unlock position, thereby said turning member is retained in the lock retaining position.

9. A hinge according to claim 8, wherein when said turning member is located in a position offset toward said lock retaining position side from the central part of said cam part, the resilient force of said turning member is converted to a turn biasing force by said cam part and said turning member is turned to the lock retaining position by this turn biasing force, and when said turning member is located in a position offset toward said unlock position side from the central part of said cam part, the resilient force of said turning member is converted to a turn biasing force by said cam part and said turning member is turned to said unlock position by this turn biasing force.

10. A hinge comprising:

a base part;

an arm;

a connection mechanism disposed between one end part of said base part and one end part of said arm;

a longitudinal direction that extends from said end part of said base part to an other end part of said base part, wherein the connector mechanism is adapted to turnably and removably connect one end part of said arm to one end part of said base part so that the other end part of said arm can approach or separate from the other end part of said base part;

a lock lever turnably disposed at the other end part of said base part; and a turn biasing means for turn-biasing said lock lever in one direction comprising, one of said other end parts of said base part and said arm which oppose each other in the axial direction orthogonal to the longitudinal direction of the base part being formed with an engagement recess which is open toward the other, wherein said other being provided with an engagement part which is brought into said engagement recess through the opening part of said engagement recess when said arm is turned to a predetermined attachment position in a direction approaching the other end part of said base part, wherein said lock lever being provided at one end part thereof with a lock part, wherein said lock part is brought into engagement with the engagement part of said arm in said attachment position, wherein said arm is prevented from turning in a direction away from said attachment position when said lock lever is turned to a predetermined lock position in said one direction by a biasing force of said turn biasing means, wherein said lock part being separated from the other end part of said arm to allow the other end part of said arm to turn in the separating direction so that said engagement part can escape from said engagement recess when said lock lever is turned in the other direction from said lock position, wherein a lock retaining means is disposed between one of said base part and said arm and said lock lever, wherein said lock retaining means is adapted to engage with a lock part disposed on the lock lever, preventing said lock lever from turning in the other direction from said lock position against the biasing force of said turn biasing means, and wherein said lock retaining means is a movable member movably disposed at said base part such that said movable member is lineally movable between a lock retaining position and an unlock position, when said movable member is moved to said lock retaining position, said movable member is engaged with said lock lever located in said lock position to prevent said lock lever from moving in the other direction from said lock position, and when said movable member is moved to said unlock position, said movable member is separated from said lock lever located in said lock position to allow said lock lever to turn in the other direction from said lock position.

* * * * *